United States Patent [19]

Weber

[11] 4,127,350

[45] Nov. 28, 1978

[54] ELASTIC JOINT SPANNING WATERSTOP ELEMENT

[75] Inventor: Victor Weber, Hinsdale, Ill.

[73] Assignee: W. R. Grace & Co., Cambridge, Mass.

[21] Appl. No.: 802,632

[22] Filed: Jun. 2, 1977

[51] Int. Cl.[2] ..... E01C 11/10

[52] U.S. Cl. ..... 404/65; 52/396

[58] Field of Search ..... 404/64, 65, 66, 68, 404/69, 47; 52/396, 403

[56] References Cited

U.S. PATENT DOCUMENTS

| | | | |
|---|---|---|---|
| 3,128,576 | 4/1964 | Bradley | 404/64 X |
| 3,583,120 | 6/1971 | Wangerow | 404/65 X |
| 3,808,762 | 5/1974 | Hurst | 404/65 X |
| 4,015,302 | 4/1977 | Clark | 404/69 X |

FOREIGN PATENT DOCUMENTS

| | | | |
|---|---|---|---|
| 549,606 | 8/1956 | Belgium | 52/396 |
| 495,853 | 9/1953 | Canada | 52/396 |
| 1,016,106 | 1/1966 | United Kingdom | 52/396 |

*Primary Examiner*—Nile C. Byers, Jr.
*Attorney, Agent, or Firm*—William L. Baker; C. Edward Parker

[57] ABSTRACT

An elastic joint-spanning waterstop of particular design for use in a method of sealing joints, in particular expansion joints between concrete sections in roads, bridge and parking deck structures against passage of water, dirt, etc., is described. In the method, recesses are formed in the concrete surface on each side of the joint and the specially designed flexible elastic joint-spanning waterstop element is placed therein, and thereafter a layer of rigid-setting grout is then placed over the element. The waterstop element is in the form of a continuous strip having in cross-section a center portion for location in the joint, and lateral joint-spanning web portions. The webs have a number of openings therethrough to admit fluid grout therein. An upstanding rib is placed between the openings and the center section and is spaced therefrom. The openings in the webs when filled with grout serve to support the upper layer of grout and to prevent flexing and cracking thereof by vehicle traffic passing thereover, as well as to anchor the webs to the concrete bodies. The upstanding rib is embedded in grout and acts to seal against passage of any water from the joint through the openings when the joint is in an expanded position and the waterstop is stretched.

6 Claims, 7 Drawing Figures

FIG. 1

FIG. 5
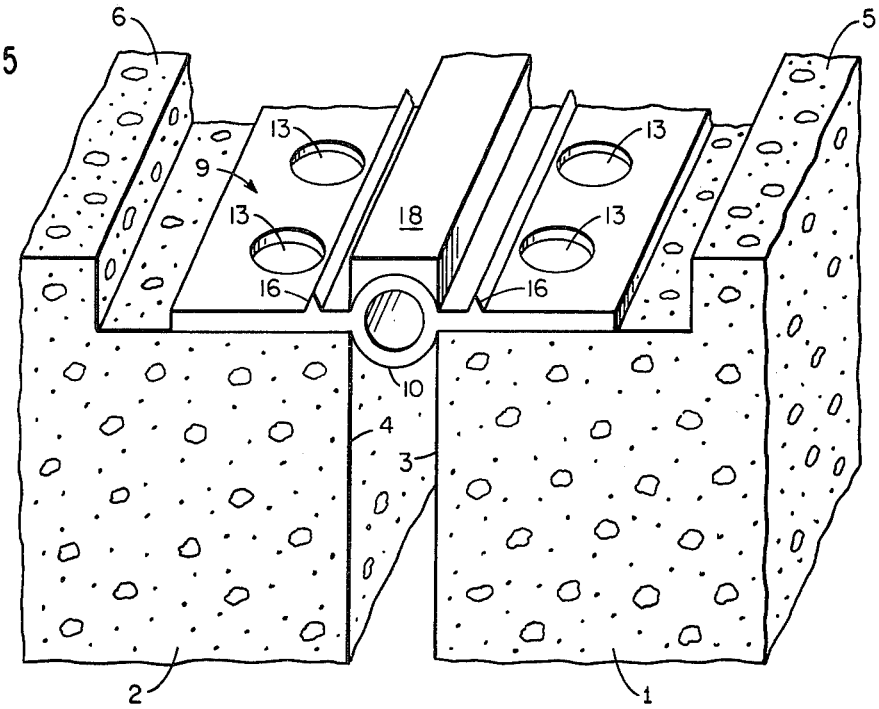
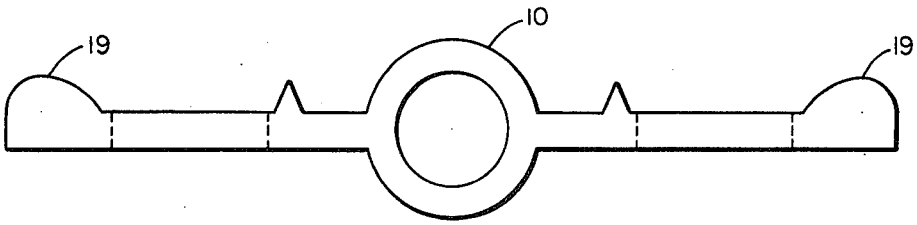
FIG. 6
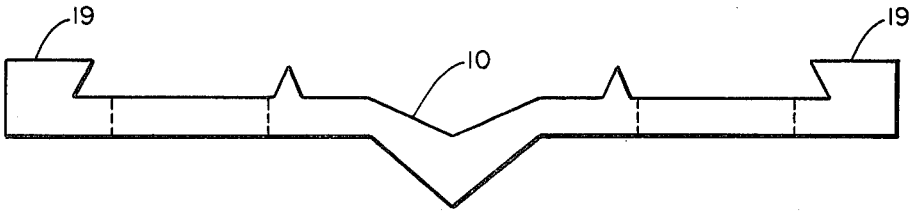
FIG. 7

ELASTIC JOINT SPANNING WATERSTOP ELEMENT

The present invention is directed to a flexible elastic, joint-spanning waterstop element specially designed for use in the method of copending application U.S. Ser. No. 802,836, filed June 2, 1977 entitled "Joint Sealing Method".

The present invention is directed to a flexible, elastic, joint-spanning waterstop element for sealing the joint between two masses of construction material, e.g. Portland cement concrete. In particular, the present invention concerns such an element for use in a relatively inexpensive method of sealing a joint space such as an expansion joint between two relatively rigid masses of structural concrete by providing such flexible sealing element across such joint at, or near, the surfaces of the concrete masses, the joint thus being rendered proof against entry of foreign materials such as dirt, water, etc., even when the concrete masses move relative to one another. The inventive waterstop element finds particular utility in the formation of waterproof joints between sections of concrete masses used in roads, highways, bridges, parking decks, etc.

BACKGROUND OF THE INVENTION

In the construction of traffic-bearing or pavement structures such as roads, bridges, parking decks, etc., using large masses of rigid construction material such as Portland cement concrete, it is well known that joints must be provided for between the rigid masses at regular intervals to allow for movement of the rigid masses due to stresses caused by traffic, changes in temperatures, etc. In construction of this type moreover where a relatively large degree of movement is expected, for instance in elevated structures such as bridge and parking decks, so-called "expansion" joints are conventionally provided for between the concrete masses which joint spaces can be up to about 3 to 4 inches in width.

Such joints or openings must be sealed in some manner in order to allow for smooth passage of traffic over the joint and/or to prevent foreign substances such as water, dirt, stones, etc., from entering the joint. The means utilized to seal the joint must be able to accommodate movement of the respective concrete bodies either horizontally and/or vertically with respect to one another. The joint-sealing means must also be able to withstand traffic thereover for reasonable lengths of time.

The most popular methods of sealing such expansion joints in road bridges, parking decks, etc. make use generally of either a pair of coacting, opposed, comb-like steel members each locked to opposite edges of the separated concrete masses, or utilize a flexible, water-resistant joint-spanning member in the form of a continuous strip of synthetic elastomeric material, e.g. neoprene rubber, polyvinyl chloride, etc. The opposed, interfitting steel member-type joints provide for somewhat smooth passage of traffic thereover and accommodate movement, but usually permit passage of water and fine solids therethrough. Therefore these joints must be used in conjunction with some means of draining this water and fines below. This type of joint is obviously relatively expensive and subject to the corrosion of the metallic members.

Expansion joints using flexible joint-spanning members in the form of continuous strips are more economic than the interfitting steel member types. Most popular are joints which utilize tough preformed, flexible, hollow neoprene members which have the added advantage of preventing passage of water, sand, dirt, stone and road salts which in particular have a corrosive effect on reinforcing steel used in the concrete bodies. Such flexible sealing members may be simply forced into formed or sawed joints in the concrete bodies while the members are in a compressed state, the elastic properties of the sealing member serving to hold the member in place in the joints. In this case however the member is subject to becoming loose should the joint expand to a greater degree than expected. Also, the member is subject to being "sucked out" of the joint by traffic passing thereover.

Methods for anchoring such flexible joint-spanning members to the respective opposed concrete bodies of the joint have also been developed. In one popular method, exemplified in U.S. Pat. No. 3,598,026 to Johnson, the flexible sealing member has portions of its lateral edges secured into heavy metal anchoring members embedded into the opposed concrete bodies. The edges are shaped such that they resist withdrawal from the metal anchors. The metal anchors ideally resist the heavy stresses placed upon them by vehicular traffic passing over the joint. Metallic anchoring members however are expensive to manufacture, and are also costly to install since they usually require welding or drilling operations. Metal is moreover subject to corrosion, and corroded anchors are expensive to repair or replace. In a more recent expansion joint-forming method exemplified in U.S. Pat. No. 3,981,601 to Arai, the lateral edges of the flexible joint-spanning member have openings preformed therethrough to receive bolts which anchor the flexible member to metallic members secured in the concrete. Again the use of such metal anchoring systems is relatively expensive. Also in the system shown in U.S. Pat. No. 3,981,601, the flexible sealing member is exposed to vehicle traffic which will cause the seal to wear at the portions where the seal is forced against the shoulders of the concrete bodies.

SUMMARY OF THE INVENTION

According to the present invention, a method of constructing a joint between two spaced rigid bodies of construction material, particularly expansion joints of elevated traffic-bearing roadways, highways, bridges, parking decks and the like, has been developed which method makes use of a flexible elastic joint-spanning element of novel design and provides a joint which will withstand traffic thereover, is proof against water, stones, sand and corrosive salts, and is comparatively simple and economic to install or replace. Briefly, in the method, a recess is formed in the portion of the upper surfaces of the opposed bodies of rigid construction material immediately adjacent the joint formed by the opposed bodies. The recessed surface is made smooth, if necessary, by sanding or by applying a grouting material and thereafter the flexible elastic joint-spanning waterstop element in continuous strip-like form is layed in the recess in a manner such that the upper surface of the member is beneath the surfaces of the opposed concrete bodies. Importantly, the member has preformed openings through its lateral edges and an upstanding rib between such openings and its center section. Thereafter, a layer of grouting material less compressible than the joint-spanning member is placed over each of the lateral edges of the joint-spanning member, care being taken that the grouting material is forced into and fills the openings through the edges of the member and embeds the upstanding rib. The upper surface layer of grouting material is made even and continuous with the surfaces of the concrete bodies.

The grouting material is selected such that it is sufficiently rigid to withstand being easily compressed by traffic passing over the joint. In this manner, the grout which has hardened in the openings in the joint-spanning member acts as a reinforcement of the upper grout layer, which would easily crack and crumble due to the passage of traffic thereover if it were merely supported by the compressible spanning member. The hardened grout in the openings also functions to lock the spanning member into the opposed concrete bodies.

The result is an economically-formed joint which makes use of the superior sealing ability of the preformed flexible, elastic joint-spanning waterstop member, without the member being subject to easy removal or to being "sucked-out" of the joint. The member moreover is secured without the necessity of using costly metallic anchoring members. Moreover, the flexible joint-spanning member is protected by an upper layer of more rigid grout so that it is not subject to rapid wear by the passage of traffic thereover. Other advantages will become obvious from the detailed description below.

BRIEF DESCRIPTION OF THE DRAWINGS

FIG. 5 is an illustration in perspective of a preferred method for forming the grout sections shown in FIG. 1; and FIGS. 6 and 7 are cross-sectional views of alternative embodiments of the inventive joint-spanning waterstop element of the invention.

DESCRIPTION OF THE PREFERRED EMBODIMENTS

The preferred aspects of the invention are best described having reference to the attached drawings and the following detailed description.

Figure 1:
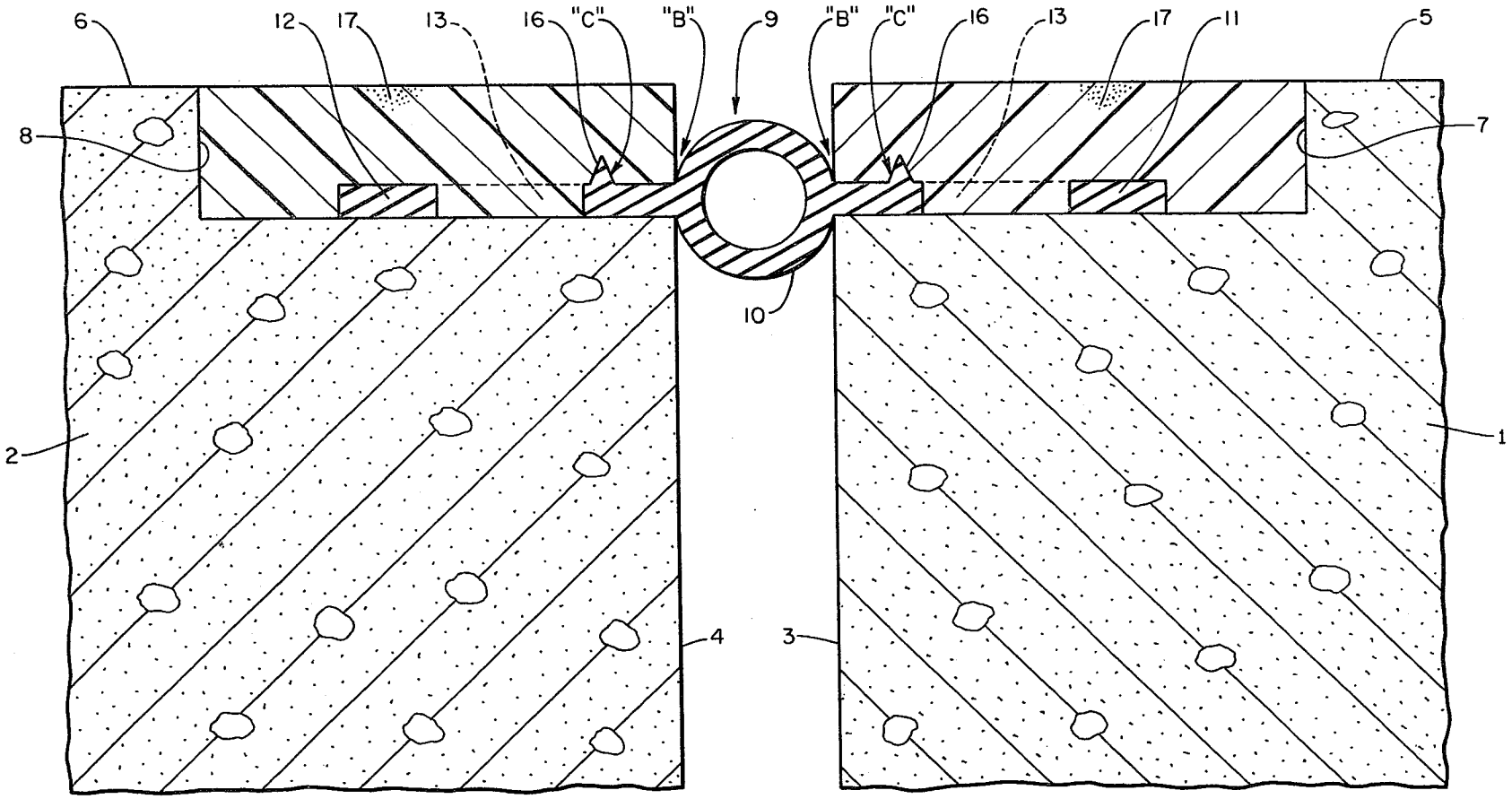
FIG. 1 is a cross sectional view of a sealed joint according to the invention, the section being taken across are lines A—A in FIG. 2.

FIG. 1 shows a vertical cross section of a horizontally extending joint formed between two horizontally cast sections of concrete 1 and 2. The joint has been sealed along its horizontal extent using the element of the invention which is in the form of a continuous strip 9, shown in perspective in FIG. 2 and as viewed from above in FIG. 3. The cross section illustrated in FIG. 1 is taken along the line A—A of FIG. 2. The joint shown in FIG. 1 is a typical "expansion" joint wherein a space, say about 1 inch wide, has been left between the concrete sections to allow for anticipated movement of the sections away from or toward one another.

In addition to opposed, joint-forming surfaces 3 and 4, each of the horizontally cast concrete sections 1 and 2 has a complementary, outer exposed, non-opposed surface, 5 and 6 respectively, which joins the opposed joint-forming surface at the locus of the joint. These exposed, non-opposed surfaces 5 and 6 may initally have actually been adjoining the opposed respective surfaces 3 and 4 at a right angle at the locus of the joint prior to the formation of recesses 7 and 8 and the recesses subsequently made, or the recesses 7 and 8 may have been formed during the casting of the concrete sections 1 and 2.

The exposed surfaces 5 and 6 further are surfaces which permit access to the joint for working purposes, that is, for installation of joint-spanning strip member 9. As pointed out above, the element of the invention has particular utility in the sealing of joints in roadways, bridge decks, parking garage decks, etc., where surfaces 5 and 6 are exposed to traffic, especially passage of heavy motor vehicles thereover. Passage of water through joints in such structures is particularly undesirable since it corrodes reinforcing metal in the concrete and leaves unsightly stains on the other side of the joints.

Figure 4:
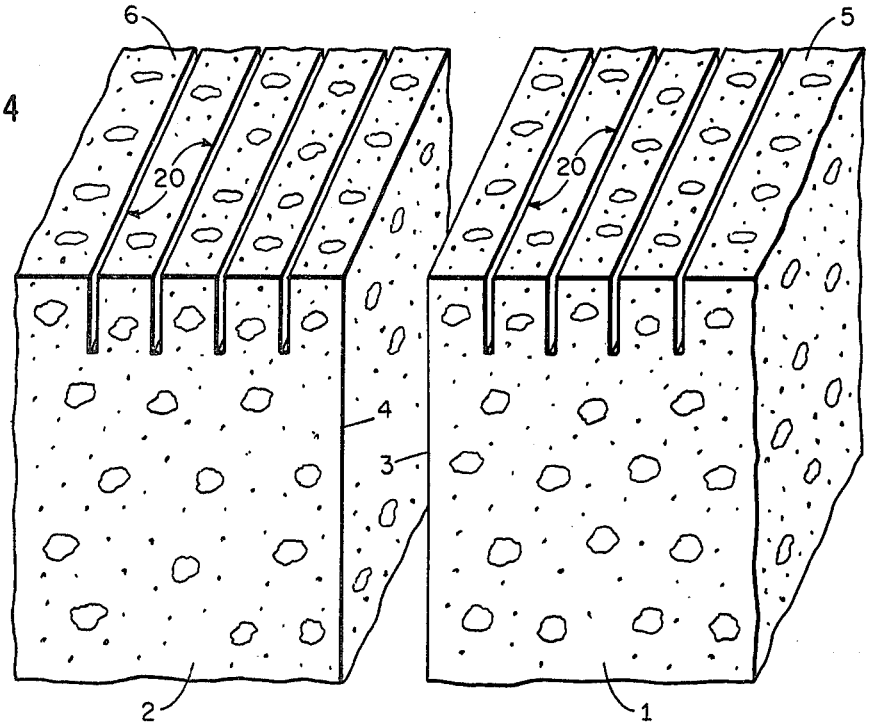
FIG. 4 is an illustration in perspective of a preferred method of making the resecces in the concrete sections shown in FIG. 1.

The first step in the installation of the inventive element is the provision of recesses 7 and 8 in concrete surfaces 1 and 2 as shown in FIG. 1. As aforementioned, these recesses can be made during the pouring of the concrete surfaces, e.g. using removable form members having the size and shape of the recesses. However, in a preferred procedure, the recesses are formed after the concrete sections have been fully formed without such recesses. After the concrete has hardened a number of generally parallel saw-cuts 20 in FIG. 4 are made along the horizontal extent of the joint in surfaces 5 and 6 on each side of the joint. The depth of the saw-cuts will determine the approximate depth of the recesses, which should in any event be greater than the cross-sectional height of the strip 9. The cut surface portions are then easily chipped or ground out to the approximate shape and size shown in FIG. 1. It may be necessary and/or desirable to apply a layer of rigid grouting material to the bottom of the recesses to give them a smooth, flat surface. A primer, e.g. epoxy when epoxy grout is used, may be desirable.

Figure 2:
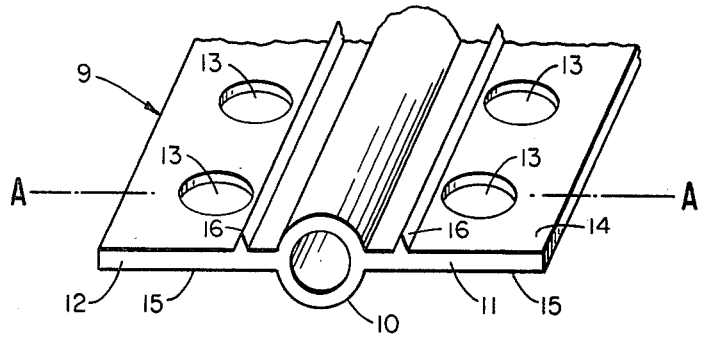
FIG. 2 is a perspective view of the novel joint-spanning waterstop element according to the present invention.
Figure 3:
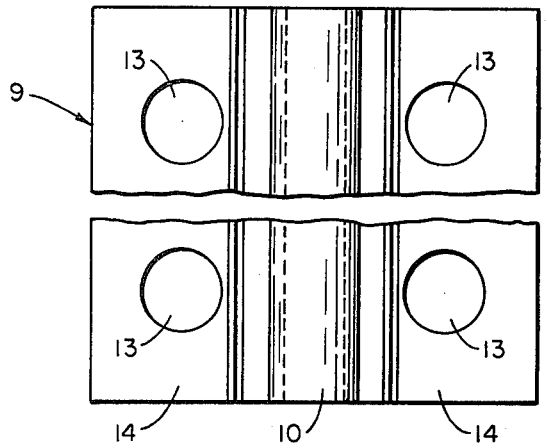
FIG. 3 is a top planar view of the element of FIG. 2.

Joint-spanning strip 9 is then layed into recesses 7 and 8 as shown in FIG. 1. As shown in FIGS. 2 and 3, the joint-spanning element 9 is in the form of a continuous length of a flexible elastic strip material which in cross section has a center section 10, and lateral web portions 11 and 12 respectively, each extending outwardly from and on opposite sides of, the center section. The web portions have a number of openings 13 therethrough connecting their upper surfaces 14 with their lower surfaces 15. The upper surfaces of the lateral web portions each further have an upstanding raised rib 16 located between openings 13 and center section 10 which runs continuously along the length of the strip as shown in FIGS. 2 and 3. The rib as shown is spaced back from the center section a suitable distance to insure that it will not be located in the joint space between the concrete sections and thus insure that it will be embedded in the covering layer of grout later applied, as shown in FIG. 1. It is preferred that the bottom surfaces 15 of webs 11 and 12 be substantially smooth surfaced as shown, that is have no similar raised or enlarged portions, which would prevent an even surface-to-surface contact between the bottom surfaces 15 of the webs and the bottom of recesses 7 and 8. The importance of maintaining such a contact is pointed out below.

In laying the joint-spanning strip 9 in the recesses, the bottom surfaces of each of web portions 11 and 12 are positioned adjacent the bottom surfaces of recesses 7 and 8 respectively. The strip is placed further such that only the central section 10 is positioned in the joint, the openings 13 and raised ribs 16 of each respective web 11 and 12 being positioned above concrete sections 1 and 2, respectively. A fluid grouting material 17 which will set or harden to a rigid mass is then placed over web portions 11 and 12, care being taken that openings 13 will be filled by the fluid grout. The surface of the grout is made even with the concrete surfaces 5 and 6 and thereafter allowed to set or harden.

The fluid grout material 17 must be prevented from entering the joint space above the center section as shown in FIG. 1. An easy method of accomplishing this is illustrated in FIG. 5. A spacer 18 in the form of a continuous strip of flexible material having a bottom surface configured such that it evenly contacts the upper surface of the center section 10 is placed on top of the center section before the grout is poured or placed. The spacer has a width corresponding to the width of the joint between concrete sections 1 and 2, and a height such that its upper surface is even with the surfaces 5 and 6 of concrete sections 1 and 2. The grout is then placed above webs 11 and 12 in the manner described previously to the height of spacer 18 and surfaces 5 and 6. The spacer is then removed preferably after the hardening of the grout.

The spacer 18 is most advantageously made of flexible material so that it can follow the contour of the center section. Moreover, a material which is also resilient and compressible is preferred in order that it will move with any corresponding movement of the joint before its removal, and thus be able to prevent grout from being damaged. A spacer further of a material which has poor adhesion to the grout and can be cut easily to fit would be obviously desirable. A preferred spacer is formed of flexible resilient synthetic resinous material such as polyvinyl chloride. The spacer can obviously be removable adhered to the center section 10 using for example a pressure sensitive adhesive having only sufficient adhesive properties to keep the spacer adhered to the strip 9 during placement of the grout, but will permit removal of the spacer without damaging the strip. The surface of the strip should be cleaned, e.g. with a solvent, before adhering the spacer.

Openings 13 are of sufficiently large size to permit the fluid grout material to flow therein without undue effort. The size, that is volume, of each opening and number thereof are such that sufficient "reinforcing columns" of hardened grout are created along the horizontal extent of the sealed joint to support the overlying layer of grout when such is stressed by traffic passing over it. A sufficient number and volume of such openings for this purpose should also normally provide for sufficient locking of the webs, and hence the joint-spanning strip itself to the concrete sections upon movement of such sections. For most grouting materials, openings 13 all of whose crosswise dimensions are at least about ¼, preferably about ¾, of an inch will suffice. The distance between each opening should not exceed about 1 to 2 inches to adequately support most grouts.

In the embodiments shown in the drawings, the joint-spanning strip 9 has a cross-sectional width of approximately 6 inches, the webs 11 and 12 a cross-sectional height of approximately ¼ inch, and the center section 10 a cross-sectional outside diameter of approximately 1 3/16 inch. The circular openings 13 shown in the strip have an approximate diameter of 1⅛ inch and are spaced approximately 1 inch apart along each web portion.

As aforementioned, the joint shown in the drawings is spaced in the manner of a typical expansion joint, and thus the center section 10 is configured such that it will stretch laterally beyond the normal elastic ability of the material from which it is made in order to insure that it will not rupture upon extreme separation of the opposed concrete sections. This is accomplished in the embodiment according to FIGS. 1–3 by making the center section in the form of a hollow round bulb. The central bulbous section will not only greatly expand laterally as the concrete sections separate but will also compress should the concrete sections move toward one another. The bulbous configuration also distorts satisfactorily should the concrete sections move upwardly and downwardly with respect to one another, that is, transversely. The center section could have an expansive center section other than a hollow bulb, for instance the deep "V" configuration shown in FIG. 7, or a "W".

The upstanding ribs 16 provide greater assurance that water which enters the joint from concrete surfaces 5 and 6 will not pass around the upper surfaces of the webs 11 and 12 of the joint-spanning strip 9. When the joint is in its normal position shown in FIG. 1, water entering the joint from above, that is surfaces 5 and 6 of concrete sections 1 and 2, is prevented from passing further between the upper surfaces 14 of the webs 11 and 12 and the grout 17 at the points "B" shown in FIG. 1 by the contact between the rounded center section 10 and the grout, and also by the contact between the upper surfaces of the webs and the grout at the points "B". This sealing action is enhanced when the concrete sections move towards one another forcing greater contact between the surfaces of the grout and the strip 9. However, should the joint expand by separation of the concrete masses, contact between the center bulb and the grout at the points "B" is lessened, and the webs 11 and 12 become thinner at the points "B" as they are stretched. The result is a much greater possibility of water passing the contact points "B". Such passing water has direct access through and around the strip 9 via openings 13 since the openings themselves will be stretched and elongated when the concrete sections are moved apart from one another, which causes a separation between the inner surfaces of the openings 13 and the rigid "posts" of grout filling the openings. The upstanding ribs 16 will prevent such water passing points "B" from getting to the openings since as the concrete sections separate apart from one another and the webs thin at points "B", the ribs will be forced against the grout at points "C" in a tighter sealing relationship.

The upper surfaces of webs 11 and 12 can be provided with raised portions 19 in FIGS. 6 and 7 at the terminal ends thereof in order to increase the resistance of webs to withdrawal from the grout 17, and also to act in a manner similar to ribs 16 in preventing water from passing around the ends of webs 11 and 12.

The bottom surfaces 15 of webs 11 and 12, which are placed adjacent the bottom of recesses 7 and 8 are as aforementioned preferably flat in order to promote a smooth continuous surface-to-surface contact with the recess bottom. This insures that no voids will be created between such surfaces into which the flexible strip 9 can be forced by traffic passing over the joint, which in turn stresses the overlying rigid grout material above the point of the voids leading to undesirable cracking thereof.

The grouting material 17 employed herein can be any material which is initially sufficiently fluid to flow into recesses 7 and 8 and openings 13; which is capable of setting, curing or hardening to a rigid mass; and, which has good adhesion to concrete. The grouting material is considerably more rigid than the flexible joint-spanning strip 9 and must be sufficiently rigid to withstand repeated impact by vehicle tires thereon, and also to prevent such tires passing over the joint from repeatedly contacting the portion of the joint-spanning strip 9 exposed at the joint opening.

A high flexural strength material such as epoxy resin unfilled or filled with a particulate mineral filler such as sand is especially suited for use as the grouting material. Upon addition of a curing agent to the resin, relatively fast-hardening grouting materials can be obtained. Good results have been obtained using "EPOXTITE GROUT", a product of W. R. Grace & Co., which is a two-component, mineral filled, thixotropic, flexible epoxy. Other rigid thermosetting synthetic resins which have similarly good adhesion to concrete are suitable also.

Another suitable grouting material for use herein comprises quick-setting inorganic cement compositions such as those based upon magnesium phosphate. A particularly quick-setting cement composition of this type is described in U.S. Pat. No. 3,960,580 to Stierli et al. The compositions described in this patent develop sufficient compressive strengths to permit traffic thereover within hours. The quick-setting cements described therein are based upon the reaction between magnesium oxide and an ammonium phosphate and can be either one or two component mixtures.

Other possible grouting materials include Portland cement or gypsum-based mortars, etc., but the comparatively longer setting times for instance of these materials make them generally less desirable.

The joint-spanning strip 9 is typically installed such that the web portions are but about 1 to 2 inches from the surfaces 5 and 6 of the concrete sections. The upper surface of the center section 10 will thus be just beneath surfaces 5 and 6, say about ¼ inch, to avoid contact with traffic passing thereover. Installation such that the upper surface of the center section is deeper than about ½ inch should be avoided since the greater depth affords collection of dirt, ice, etc., in the joint space above the center section.

The joint-spanning strip can be of any synthetic or natural resinous material which is flexible and elastic or elastomeric. Neoprene rubber and polyvinyl chloride in particular have the desired physical properties, are resistant to deterioration in use, and can be molded or extruded to the configuration shown herein.

It is obvious that specific changes, substitutions, etc. can be made in the aforedescribed detailed description without departing from the spirit of the invention.

It is claimed:

1. A flexible, elastic, joint-spanning waterstop element designed to be locked into recesses formed on either side of a joint space in two opposed, spaced, sections of concrete and at the surfaces thereof, by hardenable fluid grout placed thereover, said waterstop element being in the form of a continuous length of flexible elastic strip material having in cross-section a width greater than its height and greater than the width of said joint space, said strip further in cross-section having a center portion for location in the joint space between said concrete sections and over which no grout is placed, said center portion being configured such that it will stretch laterally beyond the normal elastic ability of the material from which it is made, said strip further having in cross-section a pair of lateral web portions over which fluid hardenable grout is placed each extending outwardly from, and on opposite sides of, said center portion; each of said web portions in cross-section having upper and lower generally planar surfaces and terminal end surfaces remote from said center portion, said upper and lower generally planar surfaces forming an angle with said center portion at the point at which each meets said center portion, said lower planar surface of each web being substantially smooth, said upper planar surface of each of said web portions in cross-section having a first upstanding rib raised therefrom continuously extending along the longitudinal length of said strip and located generally between its terminal end surface and the point at which it meets said center section but spaced back a distance from such juncture point in the direction of said terminal end surface in order that no portion of the said upstanding rib is located in the said joint space when the waterstop element is positioned between said concrete sections and in order further that said rib will be fully embedded in the fluid grout placed thereover; said web portions of said strip further each having a plurality of preformed openings therethrough located between said first raised rib and said terminal end surfaces and a second upstanding rib raised therefrom also continuously extending along the longitudinal length of said strip and located between said openings and said terminal end surfaces; the said openings in each web portion connecting the said upper and lower surfaces of said web portions, all cross-wise dimensions of said openings being at least about ¼ inch and said openings being spaced from one another along the longitudinal length of the strip a maximum distance of 1 to 2 inches.

2. The element of claim 1 wherein said center portion in cross-section is in the form of a hollow tube.

3. The element of claim 2 wherein said center portion in cross-section has a "V" configuration.

4. The element of claim 1 wherein said strip material is comprised of rubber.

5. The element of claim 4 wherein said rubber is neoprene.

6. The element of claim 1 wherein said strip material is comprised of polyvinyl chloride.

* * * * *